United States Patent [19]

Tyer

[11] Patent Number: 4,553,778

[45] Date of Patent: Nov. 19, 1985

[54] IMPLEMENT SNUBBING DEVICE

[75] Inventor: Robert C. Tyer, Keystone Heights, Fla.

[73] Assignee: Rockland, Inc., Bedford, Pa.

[21] Appl. No.: 492,176

[22] Filed: May 6, 1983

[51] Int. Cl.[4] ..... B66C 1/00

[52] U.S. Cl. ..... 294/86.4; 294/88

[58] Field of Search ..... 294/88, 86 R, 106, 118, 294/70, 67 R; 414/739, 735, 725, 651; 37/183 R, 184, 185, 186, 188

[56] References Cited

U.S. PATENT DOCUMENTS

| | | | |
|---|---|---|---|
| 320,495 | 9/1965 | Larson | 214/147 |
| 1,429,528 | 9/1922 | Payne . | |
| 1,726,272 | 8/1929 | MacDonald . | |
| 2,914,312 | 11/1959 | Cheesman | 267/1 |
| 2,917,303 | 12/1959 | Vierling | 267/8 |
| 3,384,409 | 5/1968 | Guinot | 294/88 |
| 3,491,810 | 1/1970 | Williams | 144/34 |
| 3,493,135 | 2/1970 | Novotny | 294/86 R |
| 3,592,503 | 7/1971 | Lundberg | 294/86 R |
| 3,614,931 | 10/1971 | Adler | 105/99 A |
| 3,796,332 | 3/1974 | Kawamura | 214/147 |
| 3,877,743 | 4/1975 | Johnson | 294/88 |
| 3,982,919 | 9/1976 | Wenz | 65/172 |
| 3,990,548 | 11/1976 | Schupner | 188/313 |
| 4,009,643 | 3/1977 | Thumm | 91/492 |
| 4,023,848 | 5/1977 | Bennett | 294/88 |
| 4,099,762 | 7/1978 | Hultdin et al. | 294/88 |
| 4,158,415 | 6/1979 | Young | 414/732 |
| 4,185,985 | 1/1980 | Wenz | 414/739 |
| 4,239,273 | 12/1980 | Dodemont et al. | 294/88 |

OTHER PUBLICATIONS

Esco "Skidding Grapple" Copyrights 1979 & 1980.

Esco–"Parts List 72" Grapple Head with 72" Tongs".

*Primary Examiner*—James B. Marbert

*Attorney, Agent, or Firm*—Lalos, Leeds, Keegan, Marsh, Bentzen & Kaye

[57] ABSTRACT

An implement snubbing device positionable between a boom and an implement including a compressible member positioned generally between, and having a longitudinal axis extending generally between, the boom and the implement. A boom connecting mechanism connects the compressible member to the boom, and an implement connecting mechanism connects the implement to the compressible member. The compressible member has a compressing mechanism which comprises the compressible member along the longitudinal axis and is actuated by the swinging movement of the implement about a lateral axis generally perpendicular to the longitudinal axis. A second compressing mechanism compresses the compressible device along the longitudinal axis and is actuated by the movement of the implement about a second lateral axis generally perpendicular to the first lateral axis.

52 Claims, 5 Drawing Figures

IMPLEMENT SNUBBING DEVICE

BACKGROUND OF THE INVENTION

This invention relates to an implement snubbing device positionable between an implement and a boom. It relates more particularly to such a device used with log grapples to prevent the grapple tongs when unloaded from swinging into the boom or the tractor.

In the prior art there are various devices for snubbing the movement of an implement relative to the supporting boom. These are designed to prevent the grapple head from swinging into the boom or tractor and thereby damaging the pins, cylinders, etc. One type of snubber currently being used is a friction-type clutch snubber. This device has numerous disadvantages. For example in the friction-type clutch snubber if oil or water comes into contact with the clutch plates then the snubber no longer performs properly. Also, this type of snubber must be adjusted daily. A second method of preventing the empty grapple from swinging into the boom or the grappler is to stop the tractor when empty, and winch the bucket up against the boom. This procedure slows the operating cycle down as the operator must stop the machine, and it also requires that a suitable winch be provided.

OBJECTS OF THE INVENTION

Accordingly, it is the principal object of the present invention to provide a novel improved device for snubbing the swinging motion of an implement relative to its support boom.

Another object of the present invention is to provide an implement snubbing device mounted on a log skidder or a knuckle boom loader.

A further object of the present invention is to provide a mechanism for snubbing the motion of an implement relative to a boom which does not require that the operating cycle be stopped and the implement secured to the boom or tractor when traveling in the unloaded state.

A still further object of the present invention is to provide an implement snubbing device which performs satisfactorily even when oil or water comes into contact with it.

Another object is to provide a novel implement snubbing device which does not require frequent manual adjustments.

A further object is to provide a novel implement snubbing device which is easy to adjust.

A still further object is to provide an improved implement snubbing device which includes a means allowing it to swing a small amount so the device does not absorb all the energy of the swinging and thereby damage any of the internal components.

Another object is to provide a novel implement snubbing device which utilizes a camming mechanism and further includes camming contact components which are formed of an abrasion resistant material that are easily replaceable.

Other objects of the present invention will become more apparent to those persons having ordinary skill in the art to which the present invention pertains from the foregoing description taken in conjunction with the accompanying drawings.

THE DRAWINGS

DESCRIPTION OF THE INVENTION

Figure 1:
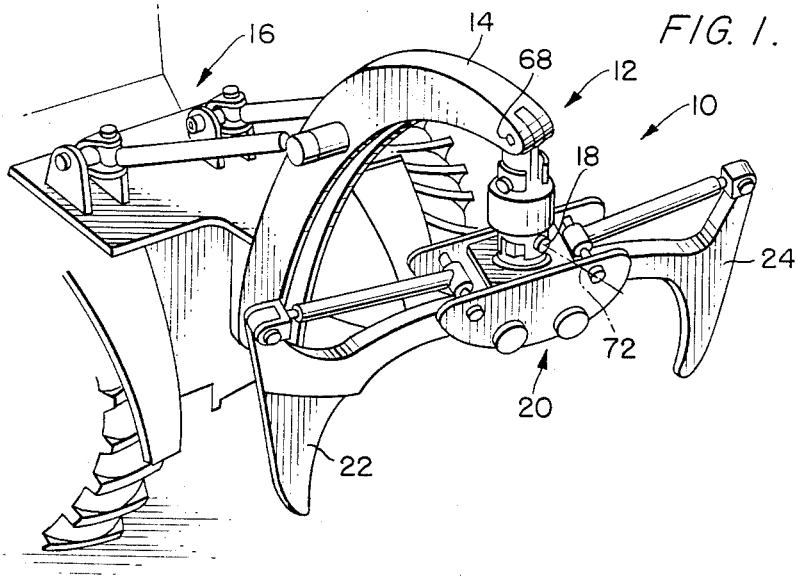
FIG. 1 is a perspective view of an apparatus embodying the present invention.
Figure 3:
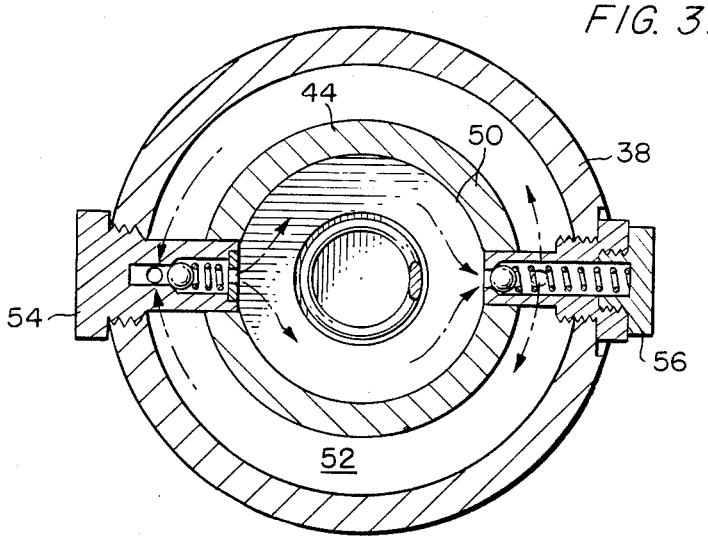
FIG. 3 is a cross-sectional view taken along line 3—3 of FIG. 2.

Referring to FIG. 1, there is illustrated an implement snubbing device of the present invention shown generally at 10. It is seen that device 10 is connected by a boom connecting mechanism shown generally at 12 to boom 14. Boom 14 is shown in FIG. 1 to comprise a curved channel member secured to the back of a tractor 16. The lower end of snubbing device 10 is connected via implement connecting mechanism shown generally at 18 to implement 20. In the preferred embodiment of this invention implement 20 comprises a log grapple which is shown in FIG. 1 to include two tongs 22 and 24 which are illustrated in their open position.

Figure 2:
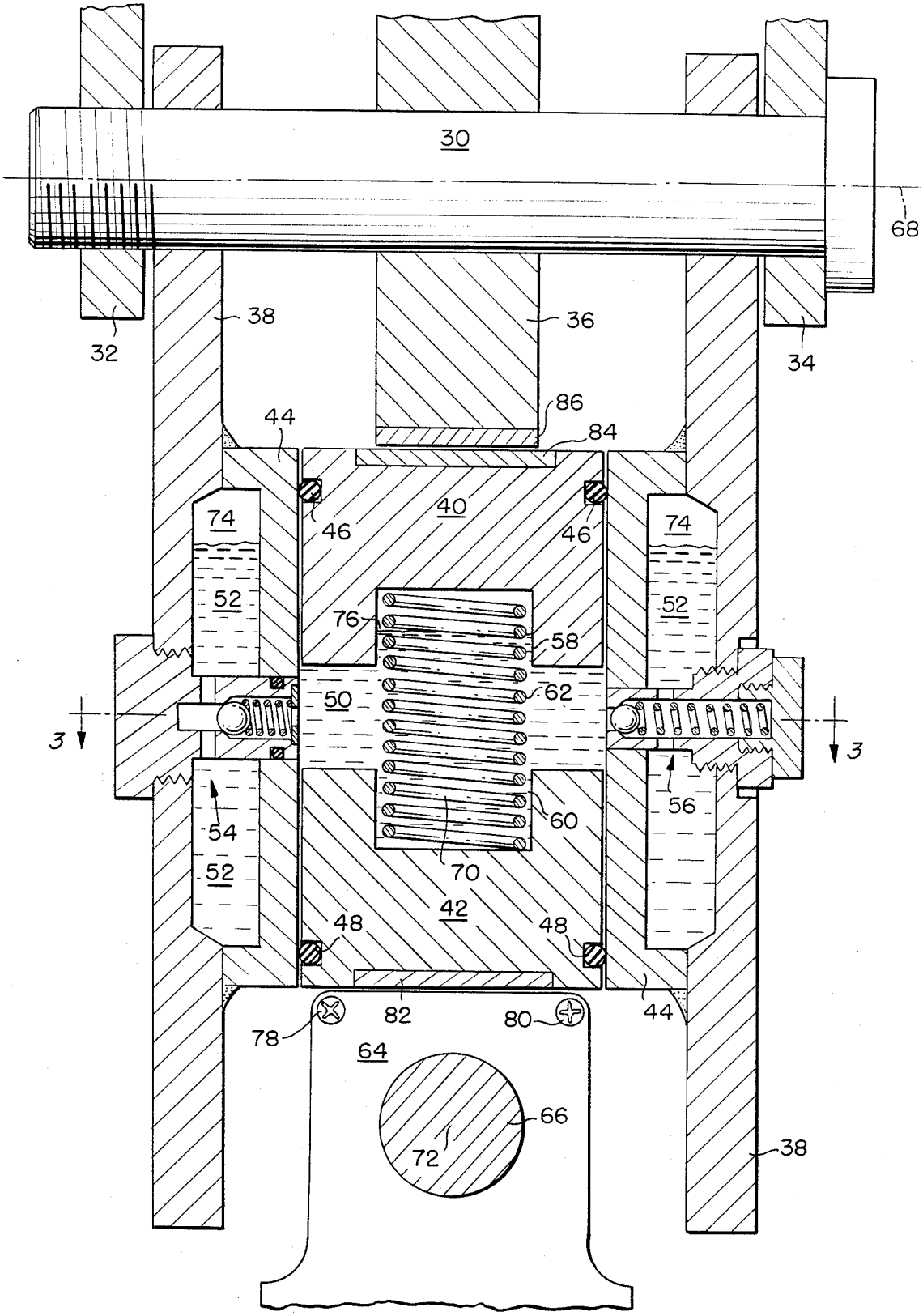
FIG. 2 is a cross-sectional view of the snubbing device of FIG. 1.

Referring to FIG. 2, the preferred embodiment of the present invention is illustrated at 10. It is seen that boom connecting mechanism 12 includes a hinge pin 30. Hinge pin 30 is shown secured to boom spindle prongs 32 and 34 which form a fork-like structure with cam 36 and move together with cam 36. Thus, as the snubbing device swings relative to the boom, pin 30 rotates in openings provided in structural sleeve 38 of the implement snubbing device, and cam 36 presses against upper piston portion 40. Upper piston portion 40 and lower piston portion 42 are disposed in steel sleeve or cylinder liner 44 and are fitted therein with sealing members 46 and 48. Oil fills the cavity 50 between upper piston portion 40 and lower piston portion 42 and communicates with oil reservoir 52 via relief valve shown generally at 54 and a one way check valve shown at 56. Upper piston portion 40 and lower piston portion 42 are configured to define an inner cylindrical surface 58 and 60 in which compression spring 62 is positioned.

A similar pivotal connection means including a lower cam 64 rotatable about the centerline of lower hinge pin 66 provides the connection of the snubbing device to the implement. It is seen that the camming action of rotation of cam 36 is about centerline 68 of hinge pin 30 which is generally horizontally disposed and perpendicular to the axis of compression 70 of the piston and spring 62. Similarly the axis of rotation of cam 64 is about axis 72 which is disposed horizontally and approximately 90° relative to axis 68. Referring to FIG. 1, it is seen that axis 68 is positioned generally perpendicular to the direction of travel of tractor 16, that is, perpendicular to the vertical plane in which boom 14 lies, and axis 72 lies in the vertical plane of boom 14.

Thus, as cam 36 cams against upper piston portion 40 thereby forcing it down towards lower piston portion 42, compression spring 62 is depressed and the oil in cavity 50 is put under pressure. When the predetermined pressure setting of relief 52 is reached relief valve 54 pops and the oil under pressure in cavity 50 flows into reservoir 52 and the desired snubbing action is maintained. When cam 36 is rotated so that it no longer presses against upper portion 40 or at least does not press against it as much the spring forces upper portion 40 upward and the oil from reservoir 52 flows through check valve 56 back into cavity 50. The pressure chamber is thereby recharged. A needle valve (not shown) communicating with the reservoir can also be included to help adjust the snubbing speed. It is further within the scope of the present invention to provide an air cushion at the top of cavity 50 as shown at 74 and at the top of reservoir 52 as shown at 76. This air cushion allows the implement to swing a small angle so the snubbing device does not absorb all of the swinging energy and thereby damage the cam or the piston. The air cushion in the reservoir helps to return the oil through the check valve (and the needle valve if any) to the cavity 50. It is also within the scope of the present invention to provide two check valves performing in part the same function as the air cushion, the check valves being set at two different pressures.

It is also seen in FIG. 2 that it is within the scope of the present invention to provide replaceable wear resistant bars shown at 78 and 80 removably mounted in cam 64 which engage a hardened steel insert 82 in lower piston portion 42. The bars and the steel insert are positioned at the areas of maximum abrasion impact and thus at the location of maximum wear. A similar insert 84 can be provided in upper piston portion 40 as well as replaceable bar(s) 86 in cam 36.

Figure 5:
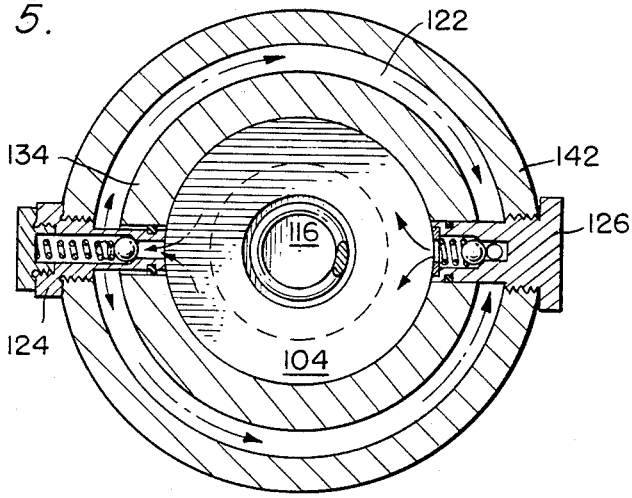
FIG. 5 is a cross-sectional view taken along line 5—5 of FIG. 4.
Figure 4:
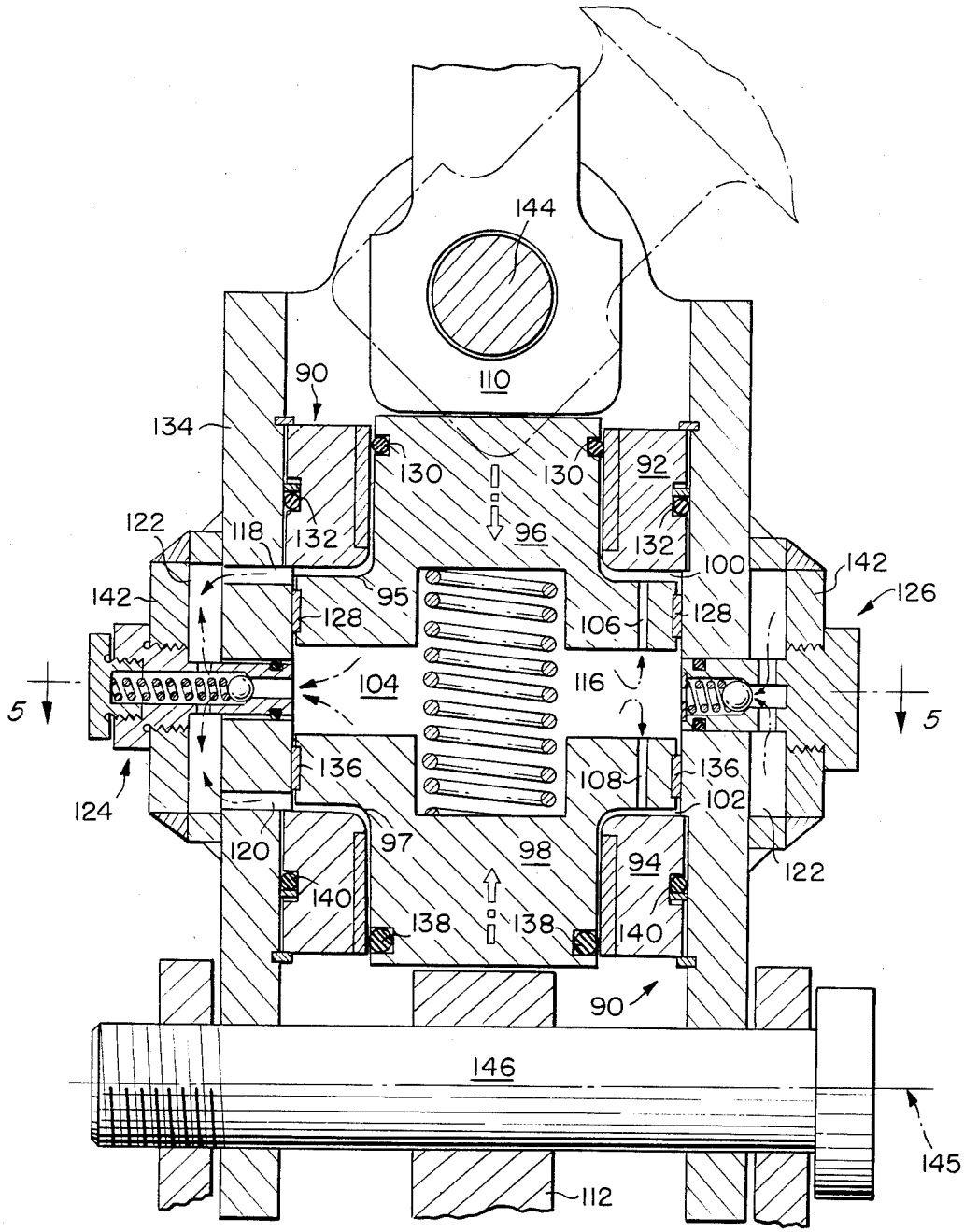
FIG. 4 is a view similar to that of FIG. 2 illustrating a second embodiment of the present invention.

The second embodiment of the present invention illustrated in FIGS. 4 and 5 essentially differs from the first embodiment in the inclusion of a gland system shown generally at 90. Gland system 90 includes an upper cylinder lining 92 and a lower cylinder lining 94 positioned to fit in a shoulder 95 of upper piston portion 96 and a shoulder 97 of lower piston portion 98, respectively. As the upper and lower piston portions are moved away from their respective cylinder liner cavities 100 and 102, respectively, are formed. Oil from main pressure chamber 104 is both forced and sucked into cavities 100 and 102 via channels 106 and 108. When cams 110 and 112 no longer press against sections 96 and 98 compression spring 116 returns them to their normal position thereby reducing the size of cavities 100 and 102. The oil in cavities 100 and 102 then flows through passageways 118 and 120 into reservoir 122. Similarly, adjustable relief valve shown generally at 124 is preset to the desired snubbing action and one way check valve shown generally at 126 allows the oil to return from the reservoir 122 to the main pressure chamber 104 when the camming action is decreased. A pressure seal is maintained in cavity 100 by primary pressure seal 128, by secondary pressure seal 130, and by static seal 132 disposed between the cylinder liner 92 and the housing 134. A similar system including a primary pressure seal 136, a secondary pressure seal 138 and a static seal 140 are provided for the lower cylinder liner 94 and for lower cavity 102. It is further seen that adjustable relief valve 124 screws into reservoir housing 142 and check valve 126 screws into reservoir housing 142 on the opposite side thereof. Reservoir housing 142 is mounted to housing 134.

Thus, when upper piston portion 96 moves because the angle of attack of cam 110 to the piston is increased (as shown by phantom lines in FIG. 4) a pressure is created in chamber 104 because relief valve 124 is preset to provide a resistance to flow to manifest the desired snubbing action. The weight of the snub section 96 or sections returns it to a neutral position. As the snubbed section or sections returns to neutral the angle of cam to piston decreases, the compression or return spring 116 pushs piston section 96 away from the pressure chamber and oil is drawn into the chamber from reservoir 122 through check valve 126 to recharge the pressure chamber. It is seen that the axis of cam 110 about pin axis 144 provides a snubbing action for one angle of swing and the camming action of cam 112 about the centerline 145 of pin 146 provides a camming action about a second angle of swing disposed generally 90° to the first angle.

From the foregoing detailed description, it will be evident that there are a number of changes, adaptations and modifications of the present invention which come within the province of those skilled in the art. However, it is intended that all such variations not departing from the spirit of the invention be considered as within the scope thereof and as limited solely by the appended claims.

I claim:

1. An implement snubbing device positionable between a boom and an implement comprising:

a compressible member positioned generally between, and having a longitudinal axis extending generally between, the boom and the implement, a boom connecting means for connecting said compressible member to the boom, and an implement connecting means for connecting the implement to said compressible member, said compressible member including a compressing means for compressing said compressible member along said longitudinal axis, said compressing means being actuated by the swinging movement of the implement about a first lateral axis generally perpendicular to said longitudinal axis, and said compressing means including a cam means rotatable about said first lateral axis thereby snubbing the rotational movement of the implement about said first lateral axis.

2. The snubbing device according to claim 1 including, said boom being positioned in a vertical plane, and said first lateral axis being horizontally disposed and generally perpendicular to said vertical plane.

3. The snubbing device according to claim 1 including, said boom being positioned in a vertical plane, and said first lateral axis being horizontally disposed and positioned generally in said vertical plane.

4. The snubbing device according to claim 1 including, said boom connecting means including a hinge pin having a longitudinal axis coincident with said first lateral axis.

5. The snubbing device according to claim 1 including, said compressible member including a piston means.

6. The snubbing device according to claim 1 including, said compressible member including a piston means, and said cam means being positioned so that it compresses said piston means as it rotates about said first lateral axis.

7. The snubbing device according to claim 6 including, said cam means having a replaceable portion positioned to contact said piston means and comprising an abrasion resistant material.

8. The snubbing device according to claim 6 including, said piston means including first and second spaced parts and a biasing means positioned between said first and second parts.

9. The snubbing device according to claim 8 including, said biasing means including a spring having a compression axis disposed generally parallel to said longitudinal axis.

10. The snubbing device according to claim 8 including, said biasing means including a hydraulic fluid system.

11. The snubbing device according to claim 10 including, said hydraulic fluid system including a pressure chamber disposed generally across said longitudinal axis, a presetting means for presetting the fluid pressure in said pressure chamber to provide the correct resistance to flow out of said pressure chamber, and a recharging means for recharging said pressure chamber.

12. The snubbing device according to claim 11 including, a compression spring means disposed in said pressure chamber.

13. The snubbing device according to claim 11 including, said hydraulic fluid system including a fluid reservoir, and said fluid reservoir communicating with said pressure chamber via said presetting means and said charging means.

14. The snubbing device according to claim 11 including, said compressible member including a piston means.

15. The snubbing device according to claim 14 including, said piston means having a replaceable portion positioned to contact said cam means and comprising an abrasion resistant material.

16. The snubbing device according to claim 14 including, said compressible member including a housing, an upper cylinder liner disposed in said housing, a lower cylinder liner disposed in said housing and spaced from said upper cylinder liner, an upper piston portion disposed in said upper cylinder liner and in said housing, and a lower piston portion disposed in said lower cylinder liner and in said housing, at least a portion of said pressure chamber being disposed between said upper and lower piston portions.

17. The snubbing device according to claim 16 including, said upper cylinder liner, said upper piston portion, and said housing defining an upper fluid chamber when said upper piston portion is in a compressed position, said upper fluid chamber communicating with said pressure chamber, said lower cylinder liner, said lower piston portion, and said housing defining a lower fluid chamber when said lower piston portion is in a compressed position, and said lower fluid chamber communicating with said pressure chamber.

18. The snubbing device according to claim 17 including, said upper fluid chamber including an upper pressure sealing means, and said lower fluid chamber including a lower pressure sealing means.

19. The snubbing device according to claim 18 including, said fluid system including a narrow communicating means for directly communicating said pressure chamber with said upper fluid chamber and said lower fluid chamber.

20. The snubbing device according to claim 19 including, said narrow communicating means including at least one needle valve.

21. The snubbing device according to claim 11 including, said fluid system including an air cushion positioned in said pressure chamber.

22. The snubbing device according to claim 1 including, a second compressing means for compressing said compressible member along said longitudinal axis and actuated by the movement of the implement about a second lateral axis not coincident with said first lateral axis and generally perpendicular to said longitudinal axis.

23. The snubbing device according to claim 22 including, said second lateral axis being generally perpendicular to said first lateral axis.

24. The snubbing device according to claim 22 including, said implement connecting means including a hinge pin having a longitudinal axis coincident with said second lateral axis.

25. The snubbing device according to claim 22 including, said compressible member including a piston means, said compressing means including a first cam means rotatable about said first lateral axis and positioned so that it compresses said piston means as it rotates about said first lateral axis, and said second compressing means including a second cam means rotatable about said second lateral axis and positioned so that it compresses said piston means as it rotates about said second lateral axis.

26. The snubbing device according to claim 25 including, said second lateral axis being generally perpendicular to said first lateral axis.

27. The snubbing device according to claim 25 including, said compressing means and said second compressing means being disposed on opposite ends of said piston means, said first cam means being positioned so that it compresses said piston means toward said second compressing means as it pivots about said first lateral axis, and said second cam means being positioned so that it compresses said piston means towards said first compressing means as it pivots about said second lateral axis.

28. An implement snubbing device positionable between a boom and an implement comprising:

a compressible member positioned generally between, and having a longitudinal axis extending generally between, the boom and the implement, a boom connecting means for connecting said compressible member to the boom, and an implement connecting means for connecting the implement to said compressible member, said compressible member including a compressing means for compressing said compressible member along said longitudinal axis, said compressing means being actuated by the swinging movement of the implement about a first lateral axis generally perpendicular to said longitudinal axis, said compressible member including a piston means, and said compressible member including a housing, an upper cylinder liner disposed in said housing, a lower cylinder liner disposed in said housing and spaced from said upper cylinder liner, an upper piston portion disposed in said upper cylinder liner and in said housing, and a lower piston portion disposed in said lower cylinder liner and in said housing, at least a portion of said pressure chamber being disposed between said upper and lower piston portions.

29. The snubbing device according to claim 28 including, said boom being positioned in a vertical plane, and said first lateral axis being horizontally disposed and generally perpendicular to said vertical plane.

30. The snubbing device according to claim 28 including, said boom being positioned in a vertical plane, and said first lateral axis being horizontally disposed and positioned generally in said vertical plane.

31. The snubbing device according to claim 28 including, said boom connecting means including a hinge pin having a longitudinal axis coincident with said first lateral axis.

32. The snubbing device according to claim 28 including, said compressing means including a cam means rotatable about said first lateral axis.

33. The snubbing device according to claim 32 including, said cam means being positioned so that it compresses said piston means as it rotates about said first lateral axis.

34. The snubbing device according to claim 33 including, said cam means having a replaceable portion positioned to contact said piston means and comprising an abrasion resistant material.

35. The snubbing device according to claim 28 including, said compressible member including a spring having a compression axis disposed generally parallel to said longitudinal axis.

36. The snubbing device according to claim 28 including, said piston means including a hydraulic fluid system.

37. The snubbing device according to claim 36 including, said hydraulic fluid system including a pressure chamber disposed generally across said longitudinal axis, a presetting means for presetting the fluid pressure in said pressure chamber to provide the correct resistance to flow out of said pressure chamber, and a recharging means for recharging said pressure chamber.

38. The snubbing device according to claim 37 including, a compression spring means disposed in said pressure chamber.

39. The snubbing device according to claim 37 including, said hydraulic fluid system including a fluid reservoir, and said fluid reservoir communicating with said pressure chamber via said presetting means and said charging means.

40. The snubbing device according to claim 28 including, said upper cylinder liner, said upper piston portion, and said housing defining an upper fluid chamber when said upper piston portion is in a compressed position, said upper fluid chamber communicating with said pressure chamber, said lower cylinder liner, said lower piston portion, and said housing defining a lower fluid chamber when said lower piston portion is in a compressed position, and said lower fluid chamber communicating with said pressure chamber.

41. The snubbing device according to claim 40 including, said upper fluid chamber including an upper pressure sealing means, and said lower fluid chamber including a lower pressure sealing means.

42. The snubbing device according to claim 41 including, said fluid system including a narrow communicating means for directly communicating said pressure chamber with said upper fluid chamber and said lower fluid chamber.

43. The snubbing device according to claim 42 including, said narrow communicating means including at least one needle valve.

44. The snubbing device according to claim 37 including, said fluid system including an air cushion positioned in said pressure chamber.

45. The snubbing device according to claim 28 including, a second compressing means for compressing said compressible member along said longitudinal axis and actuated by the movement of the implement about a second lateral axis not coincident with said first lateral axis and generally perpendicular to said longitudinal axis.

46. The snubbing device according to claim 45 including, said second lateral axis being generally perpendicular to said first lateral axis.

47. The snubbing device according to claim 45 including, said implement connecting means including a hinge pin having a longitudinal axis coincident with said second lateral axis.

48. The snubbing device according to claim 28 including, said compressible member including a piston means, said compressing means including a first cam means rotatable about said first lateral axis and positioned so that it compresses said piston means as it rotates about said first lateral axis, and said second compressing means including a second cam means rotatable about said second lateral axis and positioned so that it compresses said piston means as it rotates about said second lateral axis.

49. The snubbing device according to claim 48 including, said second lateral axis being generally perpendicular to said first lateral axis.

50. The snubbing device according to claim 48 including, said compressing means and said second compressing means being disposed on opposite ends of said piston means, said first cam means being positioned so that it compresses said piston means toward said second compressing means as it pivots about said first lateral axis, and said second cam means being positioned so that it compresses said piston means towards said first compressing means as it pivots about said second lateral axis.

51. An implement snubbing device positionable between a boom and an implement comprising:

a connection mechanism connecting the implement to said boom, a swing axis about which the implement swings relative to said boom, a snubbing means associated with said connection mechanism for snubbing the swinging movement of the implement about said swing axis, said snubbing means being actuated off of a radius of said swing axis, said snubbing means including a piston means having a longitudinal axis generally perpendicular to said swing axis and a camming means positioned to cam against said piston means in the direction of said longitudinal axis when the implement swings about said swing axis, and said piston means including a return means for returning said piston means to a generally uncammed position.

52. The snubbing device according to claim 51 including, said snubbing means snubbing the swinging movement of said implement about said swing axis and about a second swing axis disposed generally 90° relative to said swing axis.

* * * * *